United States Patent [19]

Wiedemann

[11] Patent Number: 5,000,874

[45] Date of Patent: Mar. 19, 1991

[54] CONCENTRATED COMPOSITIONS AND THEIR USE AS STABILIZERS FOR PEROXIDE-CONTAINING ALKALINE LIQUORS

[75] Inventor: Achim Wiedemann, Weil am Rhein, Fed. Rep. of Germany

[73] Assignee: Sandoz Ltd., Basel, Switzerland

[21] Appl. No.: 211,318

[22] Filed: Jun. 24, 1988

[30] Foreign Application Priority Data

Jun. 26, 1987 [DE] Fed. Rep. of Germany ..... 3721109
Dec. 5, 1987 [DE] Fed. Rep. of Germany ..... 3741231

[51] Int. Cl.[5] ..... C09K 15/32

[52] U.S. Cl. ..... 252/400.22; 252/186.27; 252/186.28

[58] Field of Search ..... 252/397, 173, 186.26, 252/186.27, 400.22, 400.24, 186.28; 260/502.5

[56] References Cited

U.S. PATENT DOCUMENTS

| | | | |
|---|---|---|---|
| 2,927,082 | 3/1960 | Young | 252/186 |
| 3,740,187 | 6/1973 | Kowalski | 8/111 |
| 3,756,775 | 9/1973 | Torsten | 8/111 |
| 3,756,776 | 9/1973 | Speakman et al. | 8/111 |
| 3,860,391 | 1/1975 | Kling et al. | 8/111 |
| 4,337,214 | 6/1982 | Rohlfs et al. | 260/502.5 |

FOREIGN PATENT DOCUMENTS

| | | |
|---|---|---|
| 1123071 | 8/1968 | United Kingdom . |
| 2016540 | 9/1979 | United Kingdom . |

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

Concentrated aqueous compositions containing (a) a hydroxy- or amino-alkanephosphonic acid
(b) a polyaminocarboxylic acid
(c) glucoheptonic acid and optionally
(d) magnesium chloride, -sulfate and/or -acetate are eminently suitable as stabilizing additives for peroxide-containing alkaline liquors which are employed in the bleach of cellulosic fibrous material.

14 Claims, No Drawings

CONCENTRATED COMPOSITIONS AND THEIR USE AS STABILIZERS FOR PEROXIDE-CONTAINING ALKALINE LIQUORS

In the bleaching of cellulosic fibrous material with aqueous peroxide-containing alkaline liquors, in particular with hydrogen peroxide, the liquors tend to destabilize, especially at higher alkali concentrations, leading to a loss of peroxide and bleaching yield. It has already been proposed to use silicates in order to stabilize the liquors. In the bleaching of textile material, however, it is not always desirable to use silicates and preference is given to silicate-free stabilizers. It has also been proposed to add hydroxy- or aminoalkanephosphonic acids or polyaminocarboxylic acids as stabilizers to such bleaching baths; however, these alone are not always sufficient to achieve the desired stabilization. In German patent No. 22 11 578 it has also been proposed to combine some of these stabilizing additives with oxy- or polyoxy-compounds with 2 to 6 carbon atoms (specifically sorbitol or gluconic acid) in order to improve the stabilization of alkaline bleaching baths.

It has now been found that glucoheptonic acid is particularly effective in combination with polyaminocarboxylic acids and with hydroxy- or amino-alkane phosphonic acids to give stable aqueous concentrated silicate-free compositions with surprisingly good stabilizing effects on peroxide-containing alkaline liquors, especially together with particular magnesium salts as defined below.

The invention provides aqueous concentrated compositions comprising (a) a hydroxy- or amino-alkanephosphonic acid, (b) a polyaminocarboxylic acid and (c) glucoheptonic acid each of components (a), (b) and (c) being in free acid or salt form.

Hydroxyalkane-phosphonic acids as components (a) preferably have 1 to 10 carbon atoms and 2 to 3 phosphonic acid groups in the molecule, more preferably 1 to 4 carbon atoms, in particular 1-hydroxypropane-1,1,3-triphosphonic acid and 1-hydroxyethane-1,1-diphosphonic acid of which the latter is particularly preferred. As aminoalkane-phosphonic acids come into consideration mainly such with 1 to 10 carbon atoms and with 2 to 5 phosphonic acid groups in the molecule, preferably aminomethanediphosphonic acid and amino compounds [in particular ammonia, $C_{2-3}$-alkylenediamine or di-($C_{2-3}$-alkylene)-triamines] polysubstituted at the nitrogen by methylenephosphonic acid groups; preferably amino-tris(methylene phosphonic acid), ethylenediamine-tetra(methylenephosphonic acid), propylenediamine-tetra(methylenephosphonic acid) and diethylenetriamine-penta(methylenephosphonic acid). Of the above phosphonic acids the aminoalkane-phosphonic acids are preferred, in particular diethylenetriamine-penta(methylenephosphonic acid).

As will be apparent from what follows, the term "polyaminocarboxylic acid", as used above with respect to component (b), is intended to include aminopolycarboxylic acids containing more than one carboxylic acid group but as few as one nitrogen atom.

Components (b) include polycarboxylic acids with preferably 1 to 3 tertiary nitrogen atoms and advantageously 3 to 5 carboxylic acid groups in the molecule, more preferably polyaminoacetic acids which advantageously are amino compounds [in particular ammonia, $C_{2-3}$-alkylene diamines or di-($C_{2-3}$-alkylene)-triamines] which are substituted at the nitrogen by methylene-carboxylic acid groups; in particular nitrolotriacetic acid, ethylenediaminetetraacetic acid and preferably diethylenetriaminepentaacetic acid.

Each of components (a), (b) and (c) may be employed in the form of the free acid or as salt, in particular as alkaline metal salts or alkaline earth metal salts, preferred salts being lithium, sodium, potassium and magnesium salts. More preferably they are used in the form of the free acids or of the sodium salts, (a) preferably in the form of the free acid, (b) and (c) preferably as salts.

Component (c) may be employed in the form of a pure single substance or also in the form of a technical, optionally racemic, substance; it may also be employed in the form of the corresponding lactone; preferably sodium glucoheptonate is employed as component (c).

With particular preference the compositions contain also (d) a water-soluble magnesium salt or salt mixture which is selected from the group consisting of magnesium chloride, magnesium sulfate and magnesium acetate;

these being preferably employed in the form of the corresponding hydrates, namely magnesium chloride hexahydrate, magnesium sulfate heptahydrate and magnesium acetate tetrahydrate. Of these magnesium chloride hexadrate is preferred.

The weight ratio of components (a), (b) and (c) and, if present, (d) is preferably such that for every 100 parts by weight of component (c) (calculated in the form of the sodium glucoheptonate) there are employed 16 to 65 parts by weight, preferably 25 to 50 parts by weight of component (a) (calculated as free acid) and 36 to 120 parts by weight, preferably 50 to 100 parts by weight of component (b) (calculated as sodium salt). Component (d) is advantageously added in such amounts that it is in molar excess over component (c); preferably 100 to 200 parts by weight, more preferably 120 to 180 parts by weight of magnesium chloride hexahydrate, or an equivalent quantity of magnesium sulfate heptahydrate and/or magnesium acetate tetrahydrate are employed for every 100 parts by weight of component (c) (calculated as sodium glucoheptonate).

The dry substance content of the concentrated compositions of the invention is advantageously in the range of 20 to 70% by weight, preferably 35 to 60% by weight, more preferably 35 to 54% by weight, the hydration water of the salts being calculated as part of the dry content. The compositions may be prepared by plain admixture of the components in water. The pH of the compositions is advantageously in the range of 2 to 8, preferably 2 to 6, in particular 2 to 4. Where (a) is an aminoalkane-phosphonic acid the pH of the concentrated compositions is with particular preference in the range of 2 to 3 and where (a) is a hydroxyalkane-phosphonic acid the pH is with particular advantage in the range of 3 to 4. If required, the pH may be lowered to the desired value e.g. by addition of a strong mineral acid, preferably sulphuric acid. The stabilizer compositions of the invention consist essentially of the above indicated components [(a), (b), (c) and water and optionally (d) and/or a strong mineral acid]. If desired, the concentrated stabilizer compositions may contain small amounts of conventional (preserving) additives, e.g. a fungicide.

The invention further provides a process for the stabilization of peroxide-containing aqueous alkaline liquors for the bleaching of cellulosic fibrous material by addition of the compositions of the invention and a process for bleaching cellulosic fibrous material with a peroxide in aqueous alkaline liquor using the compositions of the invention as stabilizers.

Any cellulosic fibrous material which is normally bleached with a peroxide under alkaline conditions, is suitable as a substrate for the bleaching process of the invention, principally cellulosic fibrous material for the production of paper (e.g. mechanical wood pulp, paper pulp and recycled paper) and textile material that contains cellulosic fibres or, in particular, consists thereof (e.g. cotton, linen, jute, hemp, ramie, sisal, coir and regenerated cellulose, as e.g. rayon and cellulose acetate) optionally in admixture with synthetic fibres, e.g. polyester fibres, polyamide fibres or polyacrylic fibres. The textile material may be in any form e.g. as loose fibres, yarns, woven or knitted goods or pile goods (e.g. with open or looped pile, in particular terry fabric).

The process of the invention is particularly suitable for bleaching textile material with no or practically no size, mainly desized goods or size-free gray goods. It is of particular interest for the semi-continuous and fully-continuous bleaching of textile webs or textile yarns wherein in the course of the bleaching process the bleaching liquor is maintained at a nearly constant composition (by further metering stock solution or reinforcing liquor and optionally alkali hydroxide solution into it) and (if necessary by addition of water) at a constant level, e.g. by exhaust methods or impregnation methods. Of particular relevance is the immersion bleaching process.

Any hydrosoluble peroxy compounds conventionally employed for bleaching are suitable for the bleaching process of the invention, in particular alkaline metal peroxides (principally sodium peroxide) or preferably hydrogen peroxide.

The bleaching process of the invention is carried out in aqueous alkaline medium. As alkali for the alkaline adjustment of the bleaching liquor there are suitably employed alkaline metal hydroxides, principally potassium or sodium hydroxide, the latter being preferred.

Conventional water qualities may be employed for the liquors (in particular bleaching liquors, stock solutions and reinforcing liquors), e.g. demineralised water or industrial water [e.g. of 2° to 8° dH (dH=German degrees of hardness) in particular 2° to 4° dH].

Any conventional bleaching devices and systems and any conventional bleaching methods as generally employed for the bleaching of cellulosic fibrous material from alkaline aqueous medium are suitable for the bleaching process of the invention. The concentrated compositions of the invention may be added directly to the bleaching bath or may be formulated into stock solutions (also reinforcing liquors) containing components (a), (b) and (c) and preferably (d) and, if desired, also alkali, before they are added to the bleaching liquor. If desired, the bleaching liquors (or also the above mentioned stock solutions) may contain further additives e.g. surfactants (in particular wetting agents) antistatic agents, softeners and optical brighteners. According to a particular feature of the invention all of the above-mentioned components with exception of the peroxide may be formulated to an aqueous stock solution, which is added as such to the bleaching liquor, the peroxide being added separately directly to the bleaching liquor or even mixed with the stock solution shortly before the addition to the bleaching liquor; if desired, the peroxide may also be present together with the remaining components in the stock preparations. Aqueous stock solutions may thus be prepared and may be metered into the bleaching liquor, the hydrogen peroxide, the sodium hydroxide solution and the additional water for the maintenance of the bleaching bath level in continuous bleaching processes may be added separately or may even be present in the same stock solution, together with (a), (b) and (c) and preferably also (d).

The bleaching may be carried out under conventional conditions and at a wide range of temperatures, mainly as occurring in the cold bleach, in continuous bleaching processes, in the hot bleach and optionally even in the bleach under HT-conditions. Preferred bleaching temperatures are in the range from 15° to 98° C. (preferably cold bleach at 15° to 30° C., immersion bleaching at 50° to 90° C., preferably 70° to 80° C., and hot bleach at 80° to 98° C.). The alkali concentration is suitably also conventional and may vary according to the chosen bleaching method; for the cold bleach it is e.g. in the range of 1.2 to 8, preferably 2° to 6° Bé, NaOH; for the other bleaching processes in longer liquor-to-goods ratio (the liquor-to-goods ratio is advantageously from 5:1 to 20:1), the pH values of the bleaching liquors are advantageously in the range of 8 to 14, preferably 9 to 12.

The concentrated compositions of the invention are suitably used in efficient amounts, i.e. in such amounts that a stabilizing effect may be observed, preferably in concentrations that correspond to 1 to 20 parts by weight of component (c) (calculated as sodium-glucoheptonate) for 100 parts by weight of 35% hydrogen peroxide. The concentrated compositions of the invention are very efficient and may display a distinct stabilizing activity even at very low concentrations. A good stabilization of reinforcing liquors and bleaching baths may be achieved with such quantities of the concentrated compositions that advantageously 1 to 10, preferably 1.2 to 4 parts by weight of component (c) (calculated as sodium-glucoheptonate) are present per 100 parts by weight of 35% hydrogen peroxide.

With the compositions of the invention there may be achieved an outstanding stabilization of reinforcing and bleaching liquors even at relatively low stabilizer concentrations and under longer lasting alkaline conditions, and consequently there may also be achieved an optimum bleaching activity of the peroxide. The concentrated aqueous stabilizer compositions of the invention are distinguished by their very good storage stability even under various pH conditions (e.g. at pH 2 to 8, particularly 2.4 to 6); this stability is particularly pronounced at higher concentrations of component (d) especially in compositions that contain 100 to 200, preferably 120 to 200 parts by weight of component (d) (calculated as magnesium chloride hexahydrate) for 100 parts by weight of component (c) (calculated as sodium glucoheptonate).

In the following examples parts and percentages are by weight and the temperatures are indicated in degrees Celsius.

EXAMPLE 1

Production of a Concentrated Composition (Which is Suitable for the Stabilization of Alkaline Hydrogen Peroxide Liquors)

125 g of sodium glucoheptonate 90 g of diethylenetriaminepentaacetic acid pentasodium salt
42 g of hydroxyethane-1,1-diphosphonic acid and
194 g of magnesium chloride hexahydrate
are homogenously admixed in 549 g of demineralised water. The resulting product has a pH of 3.4.

EXAMPLE 2

Production of a concentrated composition (which is suitable for the stabilization of alkaline hydrogen peroxide liquors)
125 g of sodium glucoheptonate
98 g of diethylentriaminepentaacetic acid pentasodium salt
39 g of diethylenetriaminepentamethylenephosphonic acid and
181 g of magnesium chloride hexahydrate
are homogenously admixed in 540 g of demineralized water and treated with sulphuric acid of 65% concentration until the pH of the composition is 2.4.

APPLICATION EXAMPLE A1 (IMMERSION BLEACHING)

A cotton jersey gray fabric is bleached by treatment in an aqueous liquor that contains 3.5 g/l of caustic soda, 18 g/l of hydrogen peroxide of 35% concentration and 3 g/l of the composition of example 1 at a liquor-to-goods ratio of 10:1, 2×20 minutes at 80° C. and then washed in the cold.

The peroxide bleaching-bath is very well stabilized by the composition of example 1. The treated material is optimally bleached.

APPLICATION EXAMPLE B1 (HOT BLEACH)

Desized woven cotton fabric is treated for 1 hour at 95° C. at a liquor-to-goods ratio of 10:1 with the following aqueous solution:
Composition according to example 1, 1 ml/l
sodium hydroxide solution of 36° Bé, 5 ml/l
$H_2O_2$ of 35% concentration, 10 ml/l.

After this treatment the goods are rinsed hot, warm and cold.

According to a particular feature of the process according to application Example B1, 1 g/l of a wetting agent is added to the bleaching liquor; the wetting agent being one of the following: sodium dodecyl benzene sulfonate, paraffin sulfonate, lauryl alcohol decaethyleneglycol monoether, tertadecanol diethyleneglycol monoether phosphoric acid partial ester sodium salt, or a mixture of two or more of these wetting agents.

APPLICATION EXAMPLES A2 AND B2

The procedures of examples A1 and B1 are repeated with the difference that instead of the composition according to example 1 the same amount of the composition according to example 2 is employed.

APPLICATION EXAMPLE C (IMMERSION BLEACHING)

In a GOLLER/STAR-TRANS washing and bleaching plant (with two dwell chambers for bleaching in the bleaching compartment) a sized web of cotton-jersey of 200 g/m$^2$ and of 140 cm width is desized in the first compartment of the plant and is bleached in the second compartment (bleaching compartment) of the plant with an aqueous bleaching liquor of the following composition.
3.5 g/l caustic soda
18.0 g/l hydrogen peroxide of 35% concentration and
3.0 g/l of the composition according to example 2
(the water being industrial water of 2° dH) continously at a liquor-to-goods ratio of 10:1 at 80° C. and with a dwelling time of 20 minutes in each of the two chambers with insertion of a cold rinsing between the two bleaching steps in the two dwell chambers; then the goods are washed in the cold.

During the bleaching process the liquors in the two dwell chambers are replenished by addition of an aqueous reinforcing liquor of the following composition:
22 ml/l of the composition according to example 2
13 ml/l of sodium hydroxide solution of 50% concentration and
110 ml/l of 35% $H_2O_2$ solution
(the water being industrial water of 2° dH), at the following rates:
dwell chamber I: 85 l/hour
dwell chamber II: 35 l/hour.

The $H_2O_2$ content of the liquor being controlled manganometrically.

The obtained bleached web is regularly and well bleached.

By replacing in this process the composition of example 2 by the one of example 1—in the bleaching liquor as well as in the reinforcing liquor—the reinforcing liquor is added at the following rates:
dwell chamber I: 85 l/hour
dwell chamber II: 60 l/hour.

In the same way as the cotton jersey, cotton terry fabric is bleached as described in the process according to application example C.

APPLICATION EXAMPLE D (IMMERSION BLEACHING)

The procedure of Application Example C is repeated with the difference that in place of a web of sized cotton-jersey a web of tenter mercerised cotton-jersey is washed in the first compartment of the plant and is bleached in the second compartment (bleaching compartment) of the plant as described in Application Example C. When the composition according to Example 1 is used for stabilization the additions of reinforcing liquor are as follows:
dwell chamber I: 95 l/h
dwell chamber II: 60 l/h.

When the composition according to Example 2 is used for stabilization the additions of reinforcing liquor are as follows:
dwell chamber I: 85 l/h
dwell chamber II: 50 l/h.

APPLICATION EXAMPLE E (BLEACHING OF MECHANICAL WOOD PULP)

2128 parts of aqueous fresh, unbleached mechanical wood pulp suspension of 4.7% concentration
0.5 parts of the composition according to example 2
3 parts of $H_2O_2$ of 40% concentration and
3 parts of aqueous 30% sodium hydroxyde solution
are homogeneously mixed in a KENNWOOD-Mixer for 1 minute and then heated to 70° C. Bleaching is carried out for 150 minutes at 70° C. After the bleach the pulp is cooled, diluted with water and acidified with diluted sulfuric acid to a pH of 4.5 to 5. The so-obtained wood pulp (0.9% concentration) has a very good degree of whiteness and may be employed directly for sheet formation.

I claim:

1. An aqueous concentrated silicate-free composition having a dry substance content in the range 20 to 70%, by weight, and a pH in the range 2 to 8 and consisting essentially of (a) a hydroxy- or amino-alkane phosphonic acid, (b) a polyaminocarboxylic acid and (c) glucoheptonic acid, each of (a), (b) and (c) being in free acid or salt form, in amounts of 16 to 65 parts, by weight, of (a), calculated as free acid, and 36 to 120 parts, by weight, of (b), calculated as sodium salt, for every 100 parts, by weight, of (c), calculated as sodium glucoheptonate, (d) 0 to 200 parts, by weight, of magnesium chloride hexahydrate or an equivalent amount of magnesium sulfate heptahydrate and/or magnesium acetate tetrahydrate for every 100 parts, by weight, of (c), calculated as sodium glucoheptonate, (e) water and (f) a strong mineral acid as required to give the specified pH.

2. A composition according to claim 1 which contains (d) 100 to 200 parts, by weight, of magnesium chloride hexahydrate or an equivalent amount of magnesium sulfate heptahydrate or magnesium acetate tetrahydrate for every 100 parts, by weight, of (c) calculated as sodium glucoheptonate.

3. A composition according to claim 1 wherein (a) is a hydroxyalkane phosphonic acid having 1 to 10 carbon atoms and 2 to 3 phosphonic acid groups or an aminoalkane phosphonic acid having 1 to 10 carbon atoms and 2 to 5 phosphonic acid groups and (b) is a polycarboxylic acid with 1 to 3 tertiary nitrogen atoms and 3 to 5 carboxylic acid groups.

4. A composition according to claim 1 wherein (a) is selected from the group consisting of 1-hydroxypropane-1,1,3-triphosphonic acid, 1-hydroxyethane-1,1-diphosphonic acid, amino-tris(methylenephosphonic acid), ethylenediamine-tetra(methylenephosphonic acid) and diethylenetriamine-penta(methylenephosphonic acid) and (b) is selected from the group consisting of nitrilotriacetic acid, ethylenediaminetetraacetic acid and diethylenetriaminepentaacetic acid.

5. A composition according to claim 2 wherein (a) is a hydroxyalkane phosphonic acid having 1 to 10 carbon atoms and 2 to 3 phosphonic acid groups or an aminoalkane phosphonic acid having 1 to 10 carbon atoms and 2 to 5 phosphonic acid groups and (b) is a polycarboxylic acid with 1 to 3 tertiary nitrogen atoms and 3 to 5 carboxylic acid groups.

6. A composition according to claim 2 wherein (a) is selected from the group consisting of 1-hydroxypropane-1,1,3-triphosphonic acid, 1-hydroxyethane-1,1-disphosphonic acid, amino-tris(methylenephosphonic acid), ethylenediamine-tetra(methylenephosphonic acid) and diethylenetriamine-penta(methylenephosphonic acid) and (b) is selected from the group consisting of nitrolotriacetic acid, ethylenediaminetetraacetic acid and diethylenetriaminepentaacetic acid.

7. A composition according to claim 3 wherein (a) is a hydroxyalkane phosphonic acid having 1 to 4 carbon atoms and 2 to 3 phosphonic acid groups or aminomethanediphosphonic acid or a product of polysubstituting a compound selected from the group consisting of ammonia, $C_{2-3}$ alkylenediamines and di-($C_{2-3}$alkylene) triamines at the nitrogen by methylenephosphonic acid groups and (b) is an amino compound selected from the group consisting of ammonia, $C_{2-3}$ alkylenediamines and di-($C_{2-3}$alkylene) triamines substituted at the nitrogen by methylene carboxylic acid groups.

8. A composition according to claim 5 wherein (a) is a hydroxyalkane phosphonic acid having 1 to 4 carbon atoms and 2 to 3 phosphonic acid groups or aminomethanediphosphosphonic acid or a product of polysubstituting a compound selected from the group consisting of ammonia, $C_{2-3}$ alkylenediamines and di-($C_{2-3}$alkylene)triamines at the nitrogen by methylenephosphonic acid groups and (b) is an amino compound selected from the group consisting of ammonia, $C_{2-3}$ alkylenediamines and di-($C_{2-3}$alkylene) triamines substituted at the nitrogen by methylene carboxylic acid groups.

9. A composition according to claim 1 having a dry substance content in the range 35 to 60%, by weight.

10. A composition according to claim 2 having a dry substance content in the range 35 to 60%, by weight.

11. A composition according to claim 3 having a dry substance content in the range 35 to 60%, by weight.

12. A composition according to claim 4 having a dry substance content in the range 35 to 60%, by weight, and a pH in the range 2 to 6.

13. A composition according to claim 5 having a dry substance content in the range 35 to 60%, by weight, and a pH in the range 2 to 6.

14. A composition according to claim 6 having a dry substance content in the range 35 to 60%, by weight, and a pH in the range 2 to 6.

* * * * *